United States Patent [19]

Wittern et al.

[11] 3,938,699

[45] Feb. 17, 1976

[54] SPRING CLIP VENDING DEVICE

[76] Inventors: Francis A. Wittern, 1616 Casady Drive, Des Moines, Iowa 50315; Arthur N. Wirstlin, 306 3rd St., SE., Altoona, Iowa 50009

[22] Filed: Jan. 29, 1974

[21] Appl. No.: 437,687

[52] U.S. Cl. ..... 221/85; 221/86

[51] Int. Cl.[2] ..... G07F 11/42

[58] Field of Search ..... 221/82–86, 221/217–220, 76–81; 198/179, 180

[56] References Cited

UNITED STATES PATENTS

| | | | |
|---|---|---|---|
| 2,103,289 | 12/1937 | Kissel | 221/86 |
| 2,351,432 | 6/1944 | Jennings et al. | 221/85 X |
| 2,686,928 | 8/1954 | Ullin | 198/179 X |
| 2,789,726 | 4/1957 | Wilson et al. | 221/84 |
| 2,809,083 | 10/1957 | Goodyear | 221/76 X |
| 2,959,141 | 11/1960 | Wilson | 198/179 X |
| 3,788,451 | 1/1974 | Cahn | 198/179 X |
| 3,789,975 | 2/1974 | Ida et al. | 198/179 X |

FOREIGN PATENTS OR APPLICATIONS

| | | | |
|---|---|---|---|
| 111,077 | 7/1925 | Switzerland | 221/219 |

*Primary Examiner*—Stanley H. Tollberg
*Assistant Examiner*—Charles A. Marmor
*Attorney, Agent, or Firm*—Henderson & Strom

[57] ABSTRACT

A vending device for use in article dispensing machines is disclosed wherein a continuous loop conveyor periodically carries a plurality of dispensing units, each unit adapted by means of a biased spring clip member to releasably hold an article to be dispensed, past a stationary cam, whereupon coaction by the dispensing unit with the cam causes the dispensing unit to release and dispense the article.

1 Claim, 6 Drawing Figures

SPRING CLIP VENDING DEVICE

BACKGROUND OF THE INVENTION

This invention relates to devices which hold and carry articles to a dispensing tray in certain types of vending machines, or which convey parts to a work station in certain manufacturing operations.

Prior art devices have most commonly included a continuous belt disposed in a vertical plane. Various shapes of hooks attached along the length of the belt have provided the means by which the articles or parts were carried by the belt. The most common variety of hook has been an L-shaped type, attached at one end to the conveyor loop with the other end directed oppositely to the flow of the conveyor movement. The hook holds the article as it moves along the lower portion of the belt and dispenses the article as it turns about the end of the loop to the upper portion of the belt. The article merely slides off the end of the hook as it turns upward. These types of prior art devices resulted in a loosely held article, the container of which had to have a special perforation/hole/adaption to receive the hook.

Other types of prior art have substituted solid units for hooks, the units being placed snug against each other so that a flap from a package might be held therebetween. While these devices have provided for firmer gripping of the articles to be dispensed, the loading of such articles has been made more difficult and the articles must still be placed in specially adapted packages.

While the prior art devices have been reasonably satisfactory, there remains a need for a reliable, easy to load vending device which can accommodate at the same time articles of a variety of shapes and sizes without the need of mechanical changes.

SUMMARY OF THE INVENTION

According to this invention, a vending device is provided for use in vending machines or manufacturing systems where articles, of different sizes if necessary, are held, conveyed, and individually released in a periodic or step-wise manner upon actuation by a given signal.

The device of this invention includes a removable shelf member to which horizontally spaced front and rear sprocket members are affixed. A continuous loop conveyor means is disposed about the sprocket members, and dispensing units, which releasably hold the articles to be dispensed, are attached at uniform intervals throughout the length of the conveyor means. A fixed cam means is located at the front sprocket and coacts with the dispensing units individually, as they advance by, upon the step-wise movement of the conveyor means. The coaction causes the unit to release the article that it is holding.

The means by which the conveyor is driven in a step-wise fashion is not considered to be a part of this invention. Any number of motors and switching mechanisms are known, coin-operated or otherwise, which would be suitable for usage with the device of this invention. It is of note, however, that only one motor is needed to operate the mechanism.

The individual dispensing units each include a spring clip member attached to a cradle member. The clip member is biased against the cradle member causing the article to be securely held therebetween. Coaction of the clip member with the cam temporarily overcomes the bias thereby causing the article to be released.

In view of the prior art, it is an object of this invention to provide an improved vending device which is simple, effective, reliable, and easy to load.

It is a further object of this invention to provide a vending device which dispenses a maximum number of articles while utilizing only a minimal number of driving motors.

Still another object of this invention is to provide a novel dispensing unit for use in a vending device.

It is further object to provide a dispensing unit which may hold articles of a variety of shapes and articles which have no specific means adapting them to be held.

These objects and other features and advantages of this invention will become readily apparent by reference to the following description when taken in conjunction with the accompanying drawings.

BRIEF DESCRIPTION OF THE DRAWINGS

The appended drawings illustrate the invention, wherein.

DESCRIPTION OF THE PREFERRED EMBODIMENT

Figures 1, 2, 3, 4, 5, 6:
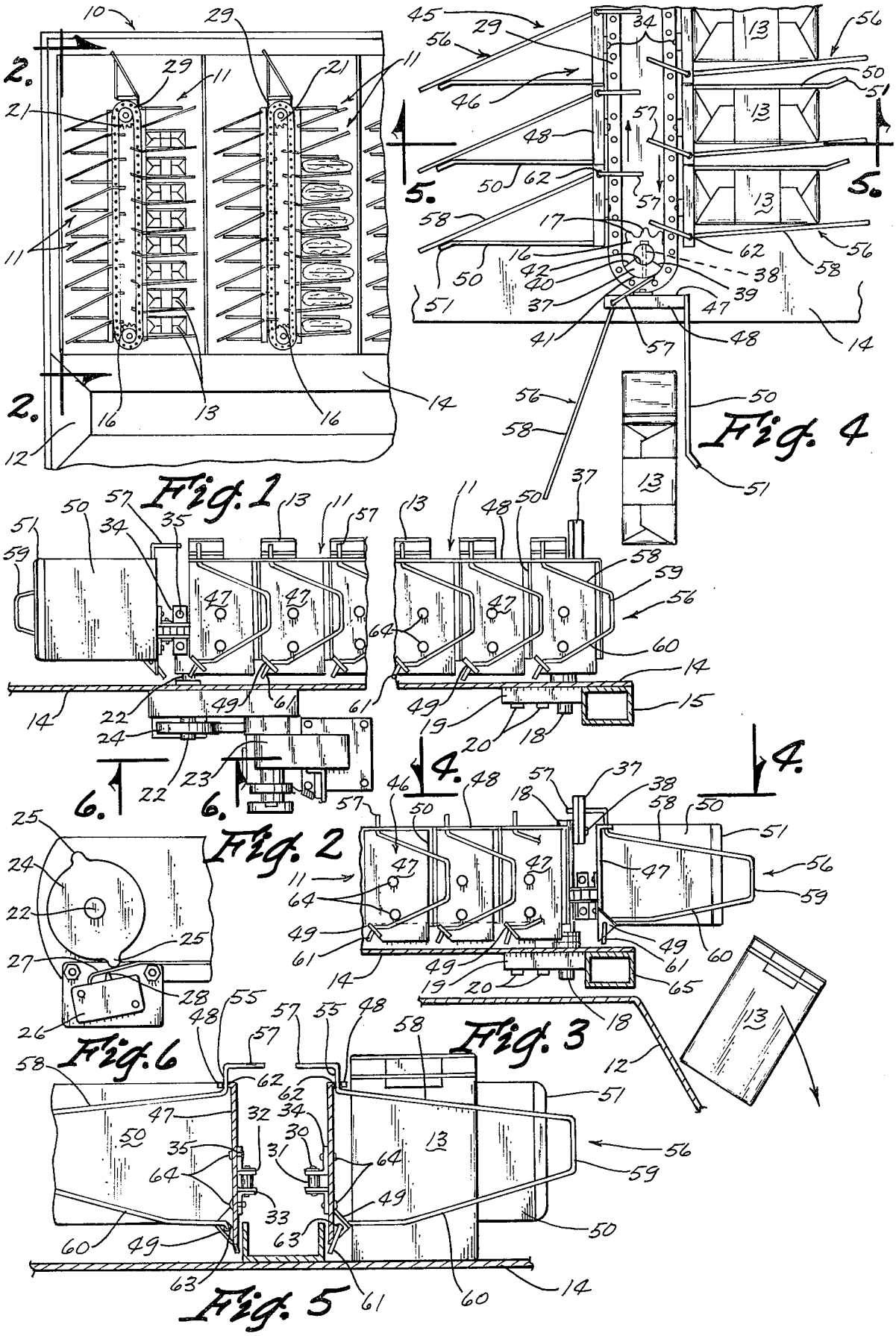
FIG. 1 is a fragmentary top plan view showing several of the vending devices of this invention within a vending machine.
FIG. 2 is an enlarged foreshortened side elevational view of the vending device taken along line 2—2 in FIG. 1, showing the rear sprocket and motor.
FIG. 3 is a fragmentary side elevational view of the vending device showing the coaction of the dispensing unit with the cam.
FIG. 4 is a top plan view of the device taken along line 4—4 of FIG. 3 and depicting the dispensing of an article.
FIG. 5 is a transverse section of the vending device taken along line 5—5 of FIG. 4.
FIG. 6 is a bottom plan view taken along line 6—6 in FIG. 2 depicting the switching mechanism which imparts step-wise motion of the vending device.

Referring now to the drawings, a vending machine is indicated generally at 10 in FIG. 1. The machine 10 comprises generally a plurality of horizontally disposed vertically spaced shelves, only one 14 showing a pair of horizontally spaced front and rear sprocket members 16 and 21 rotatably mounted each on a vertical axis to the shelf 14; a conveyor unit 29 (FIG. 4) horizontally disposed about and drivingly engaged by the sprockets 16 and 21; a cam 37 mounted on the shelf 14 above the front sprocket 16; and a plurality of dispensing units 11 attached side-by-side along the conveyor unit 29 and each adapted to hold an article 13 to be dispensed subsequently into a tray 12, the dispensing occasioned by coaction of each unit 11 with the cam 37 in a manner detailed hereinafter.

The spring clip vending device 11 more particularly includes a removable rectangular shelf 14 which rests upon guides (not shown) secured to the inner side walls of the machine 10, and which shelf includes a stabilizing bar 15 (FIG. 2) extended across the front edge thereof. A front sprocket 16 (FIG. 4) with teeth 17 is rotatably mounted upon a shaft 18. The shaft 18 (FIG. 2) passes perpendicularly through the shelf 14 into a rectangular metal bar 19 which is affixed by bolts 20 to shelf 14. A rear sprocket 21 is rotatably mounted upon a shaft 22 passing perpendicularly through shelf 14. The shaft 22 is driven by an electric motor 23 affixed to the bottom side of shelf 14. A disc 24 (FIG. 6) with a pair of lugs 25 is attached at the bottom of, and rotates with, the shaft 22. A switching device 26 with a clip 27 for changing the circuit is wired in series with the electric motor 23 and is also affixed to the bottom of shelf 14. The particular driving apparatus shown with the preferred embodiment here is not part of the claimed invention.

A continuous loop conveyor means 29 (FIG. 4) is disposed over the sprockets 16, 21. As depicted here it comprises a bicycle chain commonly known as the "roller bush" type wherein a series of pins 30 (FIG. 5) covered by rollers (not shown), which in turn are covered by bushes 31, connect upper 32 and lower 33 parallel rows of overlapping link plates. The link plates 32, 33 are here modified to each include a normally formed shoulder 34 with a centrally located hole 35 (FIG. 2). The shoulders 34 are formed at the edges of the link plates 32, 33 directed outwardly from the space enclosed by the conveyor loop 29. The shoulders 34 of the upper row of links 32 are directed oppositely of those of the lower row of links 33.

A stationary cam 37 (FIG. 3) is affixed to the front shaft 18 by means of a screw 38. The cam 37 is elongated and includes first 39 and second 40 flat side surfaces and front 41 and rear 42 arcuate surfaces (FIG. 4).

The spring clip dispensing unit 45 is indicated generally in FIG. 4. It comprises an L-shaped cradle member 46 and a spring clip member 56. The cradle member 46 includes a rectangular shaped base portion 47 (FIG. 3) having at the upper end a flange 48 formed normal thereto and in a horizontal plane, and a biasing projection 49 formed from an upturned corner at the lower end opposite the flange 48. The projection 49 is disposed in a plane angular to the horizontal plane of the flange 48. The cradle member 46 also includes a vertically disposed back portion 50 extended normal to the base portion 47 and also normal to the conveyor chain 29, the outer edge 51 of the portion 50 being bent slightly as best shown in FIG. 4 to aid in discharging the article 13.

The spring clip member 56 (FIG. 5) is a formed U-shaped wire comprising a base portion 59, a pair of diverging legs 58 and 60, an upright portion 55 leading to a cam lever 57 extended inwardly at right angles to the portion 55, and a lower biasing lever 61 which depends angularly downwardly at an obtuse angle from the lower leg 60. The clip member 56 is disposed in a single plane except for the cam lever 57 which is bent at a slight acute angle away from the plane of the clip member 56 as best illustrated in FIG. 4.

The cam lever upright portion 55 is received by flange 48 through a hole at 62 (FIG. 4), and the biasing lever 61 is received by projection 49 through a centrally located hole at 63 (FIG. 5). Due, therefore to the angular disposition of the biasing projection 49 clip member 56 is biased toward the back portion 50. By this arrangement, it may be noted that items of different sizes may be placed between the back portion 50 and the clip 56, the items resting upon the shelf, any size being useable within the limits between back portions.

Rivets 64, passed through holes in the base portion 47 aligned with holes 35 of the link plates 32, 33, attach the dispensing unit 45 to the conveyor means 29. The units 45 are attached in such a manner that the spring clip 56 and back portion 50 are directed outwardly from the conveyor loop 49 and are in planes perpendicular to the shelf 14. The base portion 47 is thereby oriented so that the flange 48 is located superior to the projection 49.

In operation, the electric motor 23 is actuated by a button, switch, or other device. The motor 23 rotates the rear shaft 22 and the rear sprocket 21 thereon, thereby driving the conveyor means 29 with the attached dispensing units 45. The disc 24 rotates with shaft 22 causing a lug 25 to periodically press a clip 27 against the switching device 26 at point 28, thereby causing the motor 23 to shut off. In this manner a periodic or step-wise motion is imparted to the conveyor means 29. It should be noted that this is but one of many ways suitable for imparting the desired step-wise motion.

During one period step, one dispensing unit 45 turns about sprocket 16 and passes by cam 37. The cam lever 57 strikes flush against the first side surface 39 of the cam 47 as the vending unit 45 begins to turn about the sprocket 16. Immediately thereafter, the lever 57 slides about the edge formed by the intersection of the side surface 39 and front arcuate surface 41. Pressure on the lever 57 gradually overcomes the bias placed on the spring clip 56 by the projection 49, and the clip 56 moves away from back portion 50 of the cradle 46.

Halfway around the sprocket 16 (FIG. 4), the lever 57 slides over the front arcuate surface 41 of the cam 37 such that the clip 56 has been forced away from the back portion 50 to an open condition so that it is in a plane at least parallel to if not diverging from the back portion of the cradle member 46 (FIG. 4). The article 13 to be dispensed is thereby released and falls within the discharge tray 12. The spacing between the clip 56 and back 50 is maintained until the lever 57 has passed over the cam surface 41, at which time the pressure from the cam 37 is released and the bias from the projection 49 causes the clip 56 to snap back against the inclined portion 51 of the back 50.

The bias on the clip 56 is easily overcome by one wishing to load the dispensing units 45 with articles 13, yet it is strong enough to firmly hold the articles 13. Furthermore, the unique combination of clip 56 and cradle 46 accomodates a wide variety of sizes and shapes or articles 13. Additionally, specially designed modifications to packages are not necessary to accomodate the packages to a machine incorporating this invention. Thus it can be seen that the objects of this invention are fulfilled.

Although a preferred embodiment has been disclosed herein, it is to be remembered that various modifications and alternate constructions can be made thereto without departing from the full scope of the invention, as defined in the appended claims.

We claim:

1. In a machine for holding and dispensing a plurality of articles individually upon the step-wise advancement of said articles by a motor associated therewith, a vending device comprising:

shelf means for directly supporting a plurality of articles to be vended;

horizontally spaced front and rear members mounted on said shelf means, one of said members being a drive member rotatable in place about a vertical axis;

conveyor means comprised of a continuous loop member horizontally disposed about and drivingly engaged by said drive member;

cam means fixedly mounted upon said shelf means;

a plurality of dispensing means for releasably and laterally holding the articles on said shelf to be dispensed, said dispensing means being attached at regular intervals along said conveyor means, operation of said conveyor means causing said dispensing means to periodically coact with said cam means to thereby cause said dispensing means to release said article to be dispensed, said dispensing means each including a cradle and a spring clip member adapted to hold an article therebetween, said spring clip member being biased against said article to be dispensed, said bias being overcome upon engagement of each of said dispensing means with said cam means to release said articles, said cradle being L-shaped and including a back portion and a base, said base being affixed to said conveyor means and said back portion extended at right angles to said base, said clip member being pivotally connected to said cradle and biased toward said back portion, said base having a horizontally disposed flame formed at its upper end and a biasing flange at its lower end securing said clip member in biasing relation, said biasing flange being formed at an angle between parallel and perpendicular to the plane of said base, and said clip member having a pair of projections inserted through openings formed therefor in said flanges.

* * * * *